US012312751B1

(12) United States Patent
Zhang et al.

(10) Patent No.: US 12,312,751 B1
(45) Date of Patent: May 27, 2025

(54) EXPANSION DEVICE FOR DEFORMATION JOINTS, PAVEMENT STRUCTURE AND CONSTRUCTION METHOD THEREOF

(71) Applicant: Jiangsu Sinoroad Engineering Technology Research Institute Co. LTD, Nanjing (CN)

(72) Inventors: Zhixiang Zhang, Nanjing (CN); Hui Zhang, Nanjing (CN); Youqiang Pan, Nanjing (CN); Menglong Zhao, Nanjing (CN); Zhidong Chen, Nanjing (CN); Yongsheng Guan, Nanjing (CN)

(73) Assignee: Jiangsu Sinoroad Engineering Technology Research Institute Co. LTD, Nanjing (CN)

( * ) Notice: Subject to any disclaimer, the term of this patent is extended or adjusted under 35 U.S.C. 154(b) by 0 days.

(21) Appl. No.: 19/031,252

(22) Filed: Jan. 17, 2025

Related U.S. Application Data

(63) Continuation of application No. PCT/CN2022/133385, filed on Nov. 22, 2022.

(30) Foreign Application Priority Data

Oct. 9, 2022 (CN) ..... 202211229290.8

(51) Int. Cl.
*E01C 11/10* (2006.01)

(52) U.S. Cl.
CPC ..... *E01C 11/10* (2013.01)

(58) Field of Classification Search
CPC ..... E01C 11/10
USPC ..... 404/47–56, 59, 71
See application file for complete search history.

(56) References Cited

U.S. PATENT DOCUMENTS 1,040,731 A * 10/1912 Moore ..... E01C 11/08 404/54
2,330,213 A * 9/1943 Heltzel ..... E01C 11/14 404/53
3,555,982 A * 1/1971 George ..... E01D 19/06 404/69
3,559,541 A * 2/1971 Watstein ..... E01C 11/14 404/60
4,319,855 A * 3/1982 Huber ..... E01D 19/06 14/73.1

(Continued)

FOREIGN PATENT DOCUMENTS

CN 205474825 U 8/2016
CN 206090213 U 4/2017

(Continued)

*Primary Examiner* — Raymond W Addie
(74) *Attorney, Agent, or Firm* — Nitin Kaushik

(57) ABSTRACT

An expansion device for deformation joints, a pavement structure and a construction method thereof. The device is installed above the deformation joint in a groove and consists of: a displacement support plate fixed above the joint; an elastic support component with fixed bases on two sides of the displacement plate and a rigid telescopic member, which is suspended above the joint and provides elasticity along the connecting line of the bases; and an elastic body that fills the groove and covers the support component. By introducing steel components into the elastic body, the device improves structural strength, integrity, and driving comfort of a pavement.

10 Claims, 5 Drawing Sheets

(56) References Cited

U.S. PATENT DOCUMENTS

| | | | | | |
|---|---|---|---|---|---|
| 4,876,759 | A * | 10/1989 | Yang | E01D 19/06 | 404/54 |
| 5,338,130 | A * | 8/1994 | Baerveldt | E01D 19/06 | 264/173.17 |
| 8,887,463 | B2 * | 11/2014 | Derrigan | E02D 17/10 | 52/573.1 |
| 9,765,486 | B1 * | 9/2017 | Robinson | E04B 1/6804 | |
| 2012/0308303 | A1 * | 12/2012 | Gallai | E01D 19/067 | 404/66 |

FOREIGN PATENT DOCUMENTS

| | | | |
|---|---|---|---|
| CN | 110965422 | A | 4/2020 |
| CN | 215629341 | U | 1/2022 |

* cited by examiner

EXPANSION DEVICE FOR DEFORMATION JOINTS, PAVEMENT STRUCTURE AND CONSTRUCTION METHOD THEREOF

CROSS-REFERENCE TO RELATED APPLICATIONS

The application claims priority to Chinese patent application No. 202211229290.8, filed on Oct. 9, 2022, the entire contents of which are incorporated herein by reference.

TECHNICAL FIELD

The invention relates to the technical field of expansion devices, in particular to an expansion device for deformation joints, a pavement structure and a construction method thereof.

BACKGROUND

Pavement, as an essential component of the road structure, directly bears vehicle loads and must ensure good load-bearing capacity, integrity, deformation resistance, and durability. Currently, typical pavement diseases focus on reflective cracks at deformation joints. Therefore, designing expansion devices at the reflective cracks has become a pressing issue that needs to be addressed.

In the prior art, such as the Chinese utility model patent CN211312061U published on Aug. 21, 2020, entitled "Pavement Expansion Joint Structure and Tool for Repairing Pavement Expansion Joints", reflective cracks are reduced by filling expansion joints with sealing glue and applying a modified hot asphalt layer, a polyester fiber cloth layer, and an asphalt mixture on top of the expansion joints.

However, the inventors found when implementing the above scheme that while the filling materials alleviate crack issues in the pavement structure to some extent, the overall deformation resistance of the filling materials remains insufficient on heavily trafficked roads with significant loads.

SUMMARY

In view of at least one of the above technical issues, the invention provides an expansion device for deformation joints, a pavement structure and a construction method thereof, utilizing structural improvements in the expansion device to enhance the overall service life at the deformation joints.

In a first aspect of the invention, an expansion device for deformation joints is provided. The device is installed in a groove above the deformation joint and comprises:

- a displacement support plate which is positioned above the deformation joint and fixed on one of two sides of the deformation joint;
- an elastic support component comprising fixed bases fixed on two sides of the displacement support plate and a rigid telescopic member connected to the two fixed bases, the rigid telescopic member being fixedly suspended above the deformation joint and having elasticity in a direction of a connecting line between the two fixed bases; and
- an elastic body which fills the groove above the deformation joint and submerges the elastic support component;
- wherein two sides of the elastic body are connected to side walls of the groove above the deformation joint, and when the deformation joint expands or contracts, the elastic support component provides a deformation buffering force.

In some embodiments, the two sides of the elastic body are coated with a sealant.

In some embodiments, an outer side of the sealant is coated with an epoxy resin interfacial agent.

In some embodiments, the displacement support plate is a steel plate, a rubber isolation layer is laid on the displacement support plate, and the elastic body is able to slide relative to the displacement support plate along with the rubber isolation layer.

In some embodiments, the rigid telescopic member is arranged linearly and comprises an inner sliding rod, a sliding sleeve fitted over the inner sliding rod, and a first spring fitted between the inner sliding rod and the sliding sleeve.

In some embodiments, the rigid telescopic member further comprises a second spring fitted over the exterior of the sliding sleeve.

In some embodiments, the rigid telescopic member is arranged in an arch shape and comprises an arch tube, the arch tube comprises an arch section and straight sections at two ends, and the rigid telescopic member further comprises inner rods fitted in the two straight sections and third springs fitted between the inner rods and the arch tube.

In some embodiments, the arch tube is further sleeved with a fourth spring.

In some embodiments, the elastic body is a high-elastic asphalt mixture.

In some embodiments, the high-elastic asphalt mixture is composed of polymer-modified asphalt and single-sized basalt aggregate, with a mass ratio of (30-40): 100;

- the polymer-modified asphalt comprises 100 parts of matrix asphalt, 15-25 parts of nano-sized rubber powder with a size of 80-250 nm, 10-15 parts of rubber particles with a size of 0.5-1 cm, 2-5 parts of activator, 1-2.5 parts of epoxy adhesive, 0.5-1.2 parts of polyvinyl alcohol fiber and 6-10 parts of composite synergist; and
- a particle size of the single-sized basalt aggregate is one of 5-10 mm, 10-15 mm and 15-20 mm.

In a second aspect of the invention, a pavement structure is provided, comprising a structural bottom plate, a base layer, a lower layer and a surface layer, wherein

- the base layer is laid on the structural bottom plate, and the base layer and the structural bottom plate are provided with a deformation joint separating the two in a vertical direction;
- the lower layer is laid on the base layer, a groove is formed in the base layer above the deformation joint, and the expansion device for deformation joints as described in the first aspect is fixed in the groove; and
- the surface layer is laid on the lower layer.

In some embodiments, the deformation joint is also filled with a caulking strip, and the caulking strip is a foam strip.

In a third aspect of the invention, a construction method of the pavement structure as described in the second aspect is provided, comprising the following steps:

- pouring a base layer of a specified thickness onto a structural bottom plate, leaving a deformation joint corresponding to the structural bottom plate, and waiting for the base layer to reach a design strength;
- pouring a lower layer on top of the base layer, and after the lower layer reaches a design strength, creating a groove in the lower layer, with the groove positioned above the deformation joint, ensuring that a bottom of the groove reveals a surface of the base layer;

placing a displacement support plate above the deformation joint, and fixing the displacement support plate on one side;

fixing elastic support components within the groove across the deformation joint, with at least two elastic components arranged in parallel and spaced along the width of a pavement;

pouring an elastic body in the groove, filling the space within the groove; and after the elastic body reaches a design strength, laying a surface layer on top of the lower layer.

The beneficial effects of the invention are as follows. By arranging the displacement support plate fixed on one side above the deformation joint and embedding the elastic support component within the elastic body, the invention improves the overall supporting strength of the elastic body compared to the prior art, thanks to the inclusion of the rigid telescopic member in the elastic support component. Further, when the elastic body deforms, the rigid telescopic member provides a buffering force, enhancing the overall service life of the elastic body.

BRIEF DESCRIPTION OF DRAWINGS

In order to more clearly explain the embodiments of the invention or the technical scheme in the prior art, the following will briefly introduce the drawings needed in the description of the embodiments or the prior art. Obviously, the drawings in the following description are only some embodiments of the invention. For those of ordinary skill in the art, other drawings can be obtained according to the provided drawings without paying creative labor.

DETAILED DESCRIPTION OF THE EMBODIMENTS

The technical schemes in the embodiments of the present invention are clearly and completely described in the following with reference to the drawings in the embodiments of the present invention. It is obvious that the described embodiments are only some of the embodiments of the present invention and are not all the embodiments thereof.

It should be noted that when an element is described as being "fixed to" another element, it may be directly on another element or there may be an intermediate element. When an element is considered to be "connected" to another element, it may be directly connected to another element or there may be an intermediate element. The terms "vertical", "horizontal", "left", "right" and similar expressions used herein are for the purpose of illustration only, and are not meant to be the only implementation way.

Unless otherwise defined, all technical terms and scientific terms used herein have the same meanings as commonly understood by those skilled in the technical field of the invention. The terms used in the specification of the invention are only for the purpose of describing specific embodiments. are not intended to limit the invention. As used herein, the term "and/or" includes any and all combinations of one or more related listed items.

Figure 1:
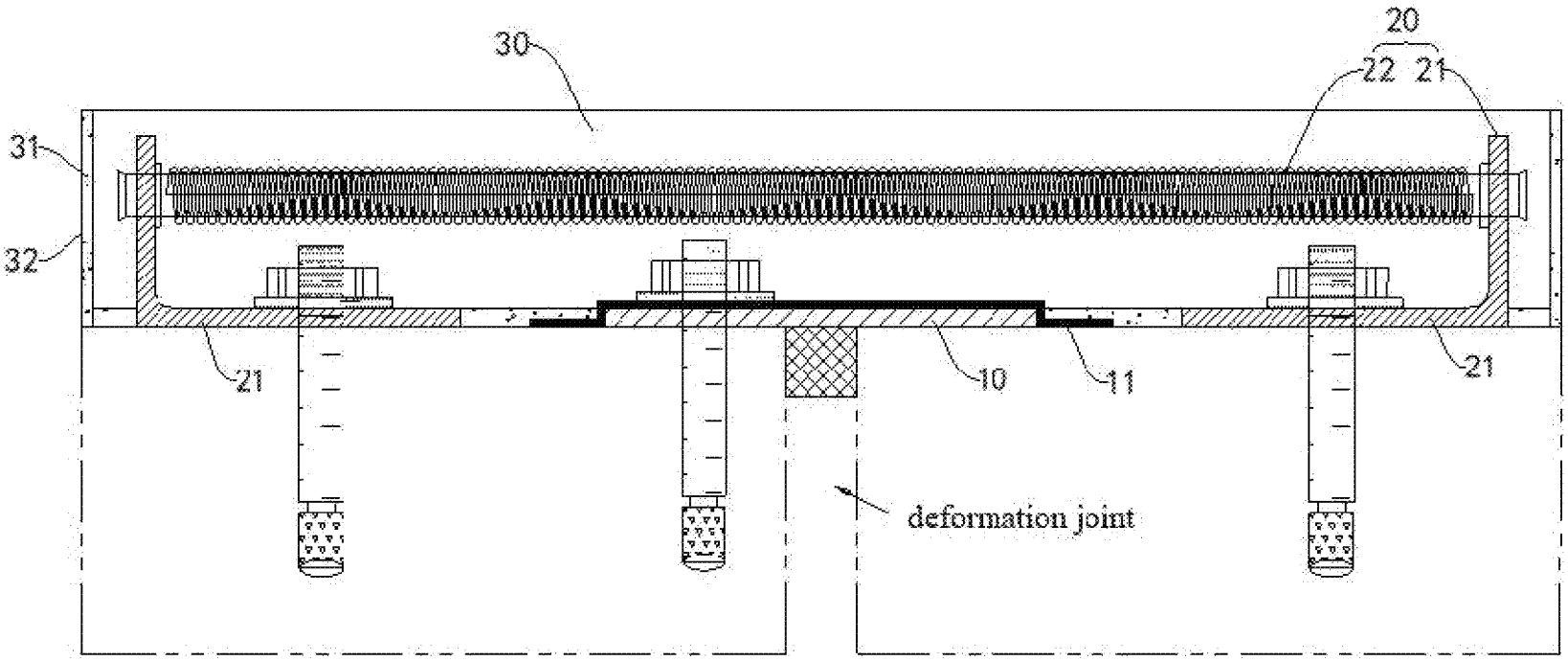
FIG. 1 is a structural diagram of an expansion device for deformation joints according to an embodiment of the invention.
Figure 2:
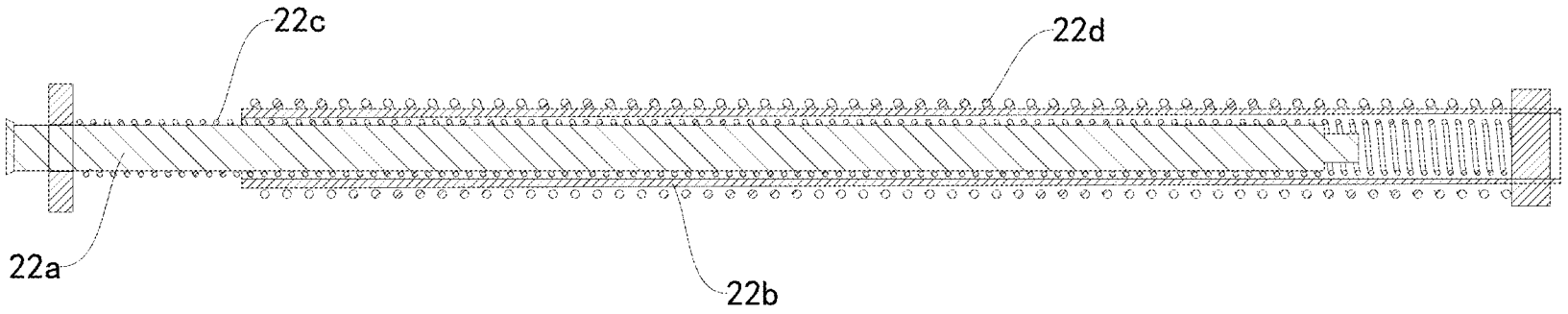
FIG. 2 is a structural diagram of an elastic support piece according to an embodiment of the invention.

An expansion device for deformation joints as shown in FIGS. 1 and 2 is installed in a groove above the deformation joint and comprises a displacement support plate 10, an elastic support component 20 and an elastic body 30.

As shown in FIG. 1, the displacement support plate 10 is positioned above the deformation joint and fixed on one of two sides of the deformation joint. It should be noted that in some embodiments of the invention, the material of the displacement support plate 10 may take various forms, such as steel plate or stainless steel alloy plate. There are multiple methods for fixing the displacement support plate 10. In some embodiments, as shown in FIG. 1, expansion screws are used for fixation. Here, the term "one of two sides" refers to fixing on either the left or right side of the deformation joint as shown in FIG. 1, while the other end remains unconstrained. This setup allows the displacement support plate 10 to cover the deformation joint, preserving the gap in the deformation joint during contraction or expansion due to temperature changes or other reasons, thus continuously fulfilling its adjustment function.

Still referring to FIG. 1, the elastic support component 20 comprises fixed bases 21 fixed on two sides of the displacement support plate 10 and a rigid telescopic member 22 connected to the two fixed bases 21, and the rigid telescopic member is fixedly suspended above the deformation joint and has elasticity in a direction of a connecting line between the two fixed bases 21; and the elastic body 30 fills the groove above the deformation joint and submerges the elastic support component 20. It should be noted that in the embodiments of the invention, the elastic body 30 is made of a high-elastic asphalt mixture, which may have various mixing ratios, and some of the embodiments will be discussed later here. By using the high-elastic asphalt mixture, adaptation to the deformation of the deformation joint is realized, allowing the elastic body 30 to stretch when the joint expands and compress when the joint contracts, without experiencing significant vertical deformation, thus avoiding depressions during stretching or protrusions during compression. In the embodiments of the invention, the elastic body 30 may accommodate deformation requirements of ±3.5 cm in the horizontal direction.

It should also be noted that in some embodiments of the invention, as shown in FIG. 1, the fixed base 21 may be an angle steel, which is fixed using expansion screws. It is understood that in other embodiments of the invention, the fixed base 21 may have various structural forms and fixation methods, such as being fixed by direct embedding or by lateral insertion, which can be decided by those skilled in the art as needed. The specific structure of the rigid telescopic member 22 may be, as shown in FIG. 2, a connecting rod linked by a spring, or may be in other forms with certain rigidity and deformable recovery, such as springs or cylinders. By introducing the elastic support piece into the elastic body 30, the deformation resistance of the elastic body 30 is enhanced.

Specifically, in some embodiments of the invention, two sides of the elastic body 30 are connected to side walls of the groove above the deformation joint, and when the deformation joint expands or contracts, the elastic support component 20 provides a deformation buffering force. The buffering force here refers to a reverse force provided by the elastic support component 20 when the elastic body 30 deforms. For example, when the elastic body 30 stretches due to the widening of the deformation joint, the elastic body 30 exerts an inward pulling force, thereby preventing excessive deformation of the elastic body 30, and vice versa. Thus, by introducing the elastic support piece into the elastic body 30, the deformation resistance of the elastic body 30 in both horizontal and vertical directions is enhanced, improving the overall reliability of use.

In the above embodiment, by arranging the displacement support plate 10 fixed on one side above the deformation joint and embedding the elastic support component 20 within the elastic body 30, the invention improves the overall supporting strength of the elastic body 30 compared to the prior art, thanks to the inclusion of the rigid telescopic member 22 in the elastic support component 20. Further, when the elastic body 30 deforms, the rigid telescopic member 22 provides a buffering force, enhancing the overall service life of the elastic body 30.

Based on the above embodiment, still referring to FIG. 1, in the embodiments of the invention, the two sides of the elastic body 30 are coated with a sealant 31. The purpose of the sealant 31 is to enhance the waterproof performance of the expansion device, preventing moisture ingress and improving the durability of the product.

Still referring to FIG. 1, an outer side of the sealant 31 is coated with an epoxy resin interfacial agent 32. It should be noted that in the embodiments of the invention, the role of the epoxy resin interfacial agent 32 is to connect the elastic body 30 to the two side walls of the groove. It is understood that using the interfacial agent for adhesion is merely one implementation method in the embodiments of the invention, and other structural forms will be introduced later.

In the embodiments of the invention, the displacement support plate 10 is a steel plate. Specifically, the width of the steel plate is no less than 25% of the width of the groove, and the thickness of the steel plate is set between 4 to 6 mm. Since one side of the displacement support plate 10 is fixed, when deformation occurs in the deformation joint, the displacement steel plate will experience a certain relative displacement with respect to the elastic body 30. To reduce the damage to the elastic body 30 caused by the relative displacement between the elastic body 30 and the steel plate, in the embodiments of the invention, as shown in FIG. 1, a rubber isolation layer is laid on the displacement support plate 10, allowing the elastic body 30 to slide relative to the displacement support plate 10 along with the rubber isolation layer. During the application, the rubber isolation layer is directly laid on the steel plate, so that during stretching or compression, the elastic body 30 can move over the steel plate along with the rubber isolation layer, thereby reducing the constraints thereon. This effectively provides a protective layer for the elastic body 30, minimizing friction and constraints with the steel plate and reducing damage to the elastic body 30. In one embodiment of the invention, the rubber isolation layer is made of EPDM, with a thickness of 2 mm, and it extends 20 mm longer than the displacement support plate 10 on both sides.

The specific structural form of the rigid telescopic member 22 is shown in FIG. 1. In some embodiments of the invention, the rigid telescopic member 22 is arranged linearly and comprises an inner sliding rod 22*a*, a sliding sleeve 22*b* fitted over the inner sliding rod 22*a*, and a first spring 22*c* fitted between the inner sliding rod 22*a* and the sliding sleeve 22*b*. It should be noted that in some embodiments of the invention, the length of the inner sliding rod 22*a* is smaller than the length of the sliding sleeve 22*b*, and the length of the first spring 22*c* is greater than the length of the inner sliding rod 22*a*. Consequently, as the inner sliding rod 22*a* moves toward the inside of the sliding sleeve 22*b*, the first spring 22*c* gets compressed, resulting in a reverse elastic force. This design offers a constraint in the horizontal direction.

Further, in the embodiments of the invention, referring to FIG. 2, the rigid telescopic member 22 further comprises a second spring 22*d* fitted over the exterior of the sliding sleeve 22*b*. Since the second spring 22*d* is fitted over the sliding sleeve 22*b*, during the pouring of the elastic body 30, the remaining part of the second spring 22*d* is bonded and cured together with the elastic body 30. This way, the second spring 22*d* also restricts the deformation of the elastic body 30 in the vertical direction, preventing arching or sinking due to the constraints of the second spring 22*d* and the sliding sleeve 22*b* during the stretching or compression of the elastic body 30.

Further, it should also be noted that in the embodiments of the invention, there is no limitation on the number of elastic support pieces, which can be decided by those skilled in the art according to actual working conditions.

Figure 3:
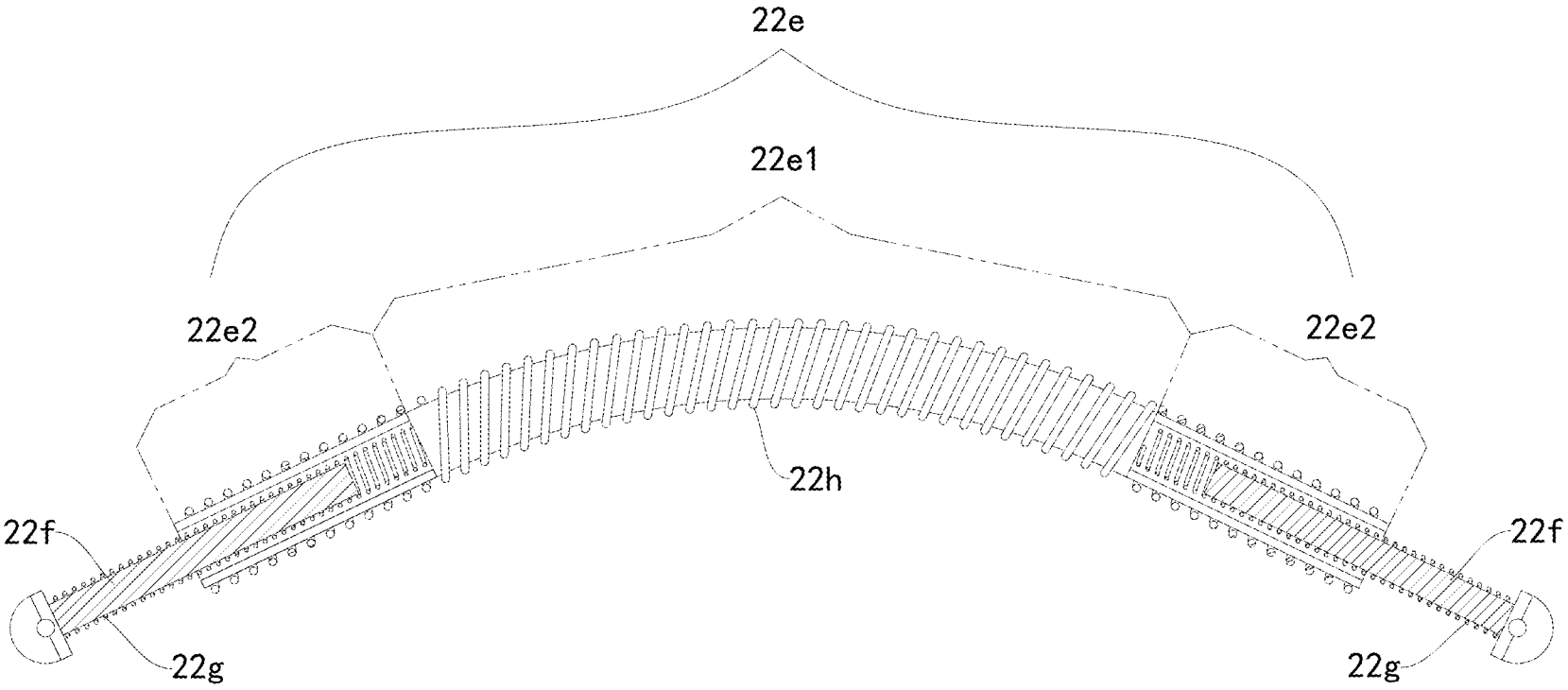
FIG. 3 is a structural diagram of another elastic support piece according to an embodiment of the invention.

In some other embodiments of the invention, the structural form of the rigid telescopic member 22 is modified, as shown in FIG. 3. The rigid telescopic member 22 is arranged in an arch shape and comprises an arch tube 22*e*, the arch tube 22*e* comprises an arch section 22*e*1 and straight sections 22*e*2 at two ends, and the rigid telescopic member 22 further comprises inner rods 22*f* fitted in the two straight sections 22*e*2 and third springs 22*g* fitted between the inner rods 22*f* and the arch tube 22*e*. By designing the rigid telescopic member 22 in an arch shape, it can provide vertical support, preventing the rigid telescopic member 22 from sinking under heavy loads, which would affect its telescopic performance. As depicted in FIG. 3, in some embodiments of the invention, the straight sections 22*e*2 at both ends are arranged in an inclined manner; however, in other embodiments, the straight sections 22*e*2 may also be positioned horizontally. This embodiment achieves a higher strength of support through the arch structure, enhancing the use reliability of the rigid telescopic member 22. Similarly, in some embodiments of the invention, the arch tube 22*e* is further sleeved with a fourth spring 22*h*. The function of the fourth spring 22*h* is the same as that of the second spring 22*d*, which will not be repeated here.

In some embodiments of the invention, the elastic body 30 is a high-elastic asphalt mixture. Specifically, the high-elastic asphalt mixture is composed of polymer-modified asphalt and single-sized basalt aggregate, with a mass ratio of (30-40):100. Those skilled in the art may adjust the mass ratio according to technical requirements.

The polymer-modified asphalt comprises 100 parts of matrix asphalt, 15-25 parts of nano-sized rubber powder with a size of 80-250 nm, 10-15 parts of rubber particles with a size of 0.5-1 cm, 2-5 parts of activator, 1-2.5 parts of epoxy adhesive, 0.5-1.2 parts of polyvinyl alcohol fiber and 6-10 parts of composite synergist; and a particle size of the single-sized basalt aggregate is one of 5-10 mm, 10-15 mm and 15-20 mm.

In some embodiments of the invention, one implementation regarding the formulation of the polymer-modified asphalt is as follows: the polymer-modified asphalt comprises, by weight, 100 parts of matrix asphalt, 15-25 parts of nano-sized rubber powder with a size of 80-250 nm, 10-15 parts of rubber particles with a size of 0.5-1 cm, 2-5 parts of activator, 1-2.5 parts of epoxy adhesive, 0.5-1.2 parts of polyvinyl alcohol fiber and 6-10 parts of composite synergist. The specified technical indicators in the table below are met through the above formulation.

TABLE 1

Technical Indicators of High-Elastic Asphalt Mixture 7

| Test item | Technical requirement | Test method |
|---|---|---|
| Dynamic stability of rutting test (40° C., 0.7 MPa) (times/mm) | ≥3000 | T0719 |
| Failure strain of low temperature bending test (−10° C., 50 mm/min) (με) | ≥50000 | T0715 |
| OT fatigue times (25° C., 0.625 mm) (times) | ≥1000 | TxDOT Designation: Tex-248-F |

The expansion device for deformation joints in the embodiments of the invention, through the above structural configuration, demonstrates good traffic load-bearing capacity and excellent deformation resistance. It can effectively absorb the horizontal and vertical deformations caused by the expansion and contraction of concrete slabs and the impact of vehicle loads, significantly reducing the probability of reflective cracks in a pavement structure.

Figure 4:
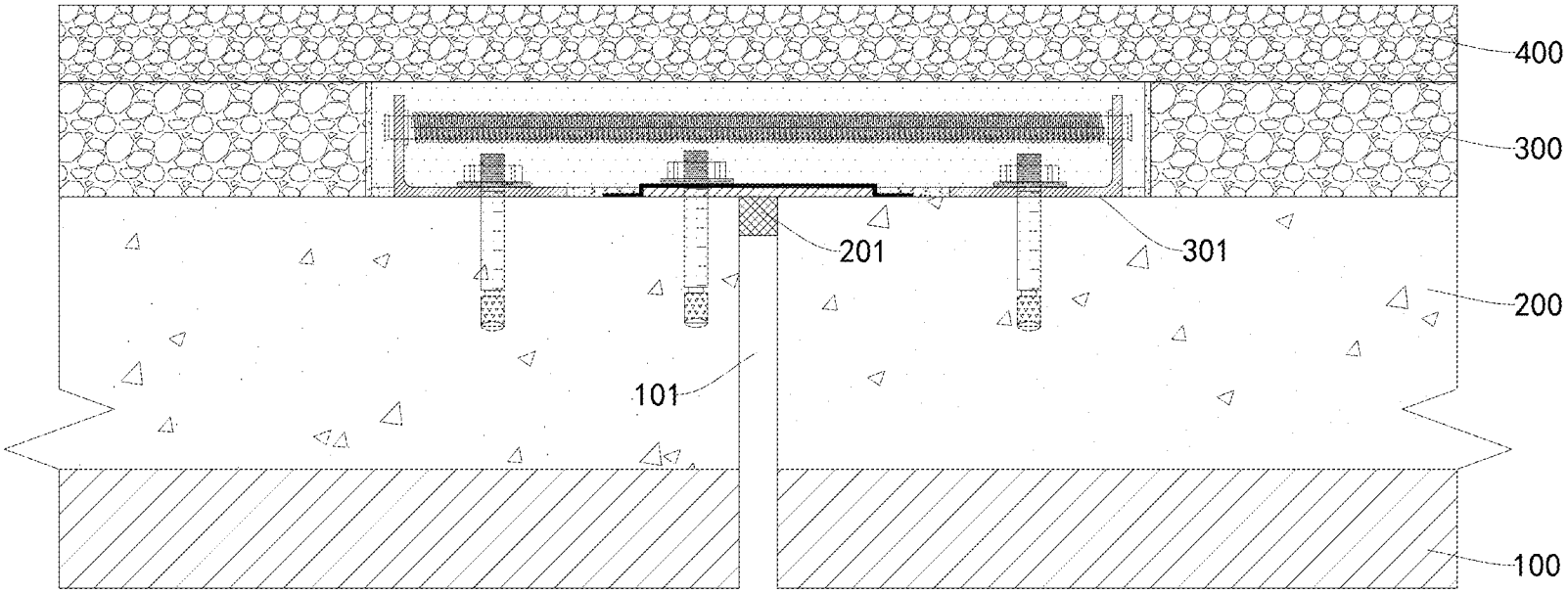
FIG. 4 is a sectional view of a pavement structure according to an embodiment of the invention.

According to another aspect of the embodiments of the invention, a pavement structure is provided as shown in FIG. 4, which comprises a structural bottom plate 100, a base layer 200, a lower layer 300 and a surface layer 400, wherein the base layer 200 is laid on the structural bottom plate 100, and the base layer 200 and the structural bottom plate 100 are provided with a deformation joint 101 separating the two in a vertical direction; the lower layer 300 is laid on the base layer 200, a groove 301 is formed in the base layer 200 above the deformation joint 101, and the expansion device for deformation joints 101 is fixed in the groove 301; and the surface layer 400 is laid on the lower layer 300. By incorporating the surface layer 400, the embodiments of the invention prevent the elastic body 30 from coming into direct contact with vehicles, extending the service life of the tunnel deformation joint 101, while the uniform pouring of the surface layer 400 enhances the integrity and comfort of the pavement.

Specifically, in one embodiment of the invention, the surface layer 400 uses warm-mixed flame-retardant asphalt concrete with a thickness of 40-45 mm.

The lower layer 300 employs warm-mixed asphalt concrete with a thickness of 60-65 mm. The base layer 200 uses an ultra-tough cement-based composite material with a thickness of 200-250 mm.

Further, in some embodiments of the invention, the elastic body 30 in the deformation joint and the groove 301 may be connected by utilizing the epoxy resin interfacial agent 32 mentioned above. Specifically, the application amount of the epoxy resin interfacial agent 32 is 1-1.5 kg/m$^2$. It should also be noted that there are other structural forms for the connection between the elastic body 30 and the groove 301. In some embodiments of the invention, embedded components or step forms may be used, or improvements may be made to the structure of the groove 301 and two ends of the elastic body 30 are configured in an inverted U-shape, allowing for pouring and interconnection with the pavements on both sides to enhance the reliability of the connection.

Still referring to FIG. 4, in the embodiments of the invention, the deformation joint 101 is also filled with a caulking strip 201, and the caulking strip 201 is a foam strip. It should be noted that the installation of the caulking strip 201 can effectively protect the deformation joint 101. The foam strip used here is compressible and capable of resisting temperatures of at least 220° C.

In the above embodiments, the integrity of the flexible deformation pavement with the main tunnel structure and the adjacent asphalt pavements on both sides is enhanced by introducing steel components at the deformation joint 101, which also improves resistance to horizontal and vertical deformations. The application of the epoxy resin interfacial agent 32 on the surface of the groove 301 strengthens the bonding performance at the contact surface between the flexible deformation pavement and the main tunnel structure as well as the adjacent asphalt pavements. The elastic body 30 within the groove 301 uses the high elastic asphalt mixture capable of large deformations, absorbing the expansion and contraction of the concrete slab. Meanwhile, under certain compressive conditions, the single-sized aggregate gradually forms a void framework structure after being compressed, effectively limiting the deformation of the pavement structure. This system can accommodate a deformation range of ±3.5 cm in the horizontal direction, which meets the large deformation requirements at tunnel entrance and exit locations, as well as structural settlement joints inside the tunnel. The base layer 200 uses the ultra-tough cement-based composite material to replace traditional cement concrete, thereby improving the bending resistance and tensile strength of the pavement structure, reducing the risk of swelling at the deformation joint 101, and effectively preventing the intrusion of harmful external substances, thus meeting the crack resistance and impermeability requirements of the main tunnel structure.

Figure 5:
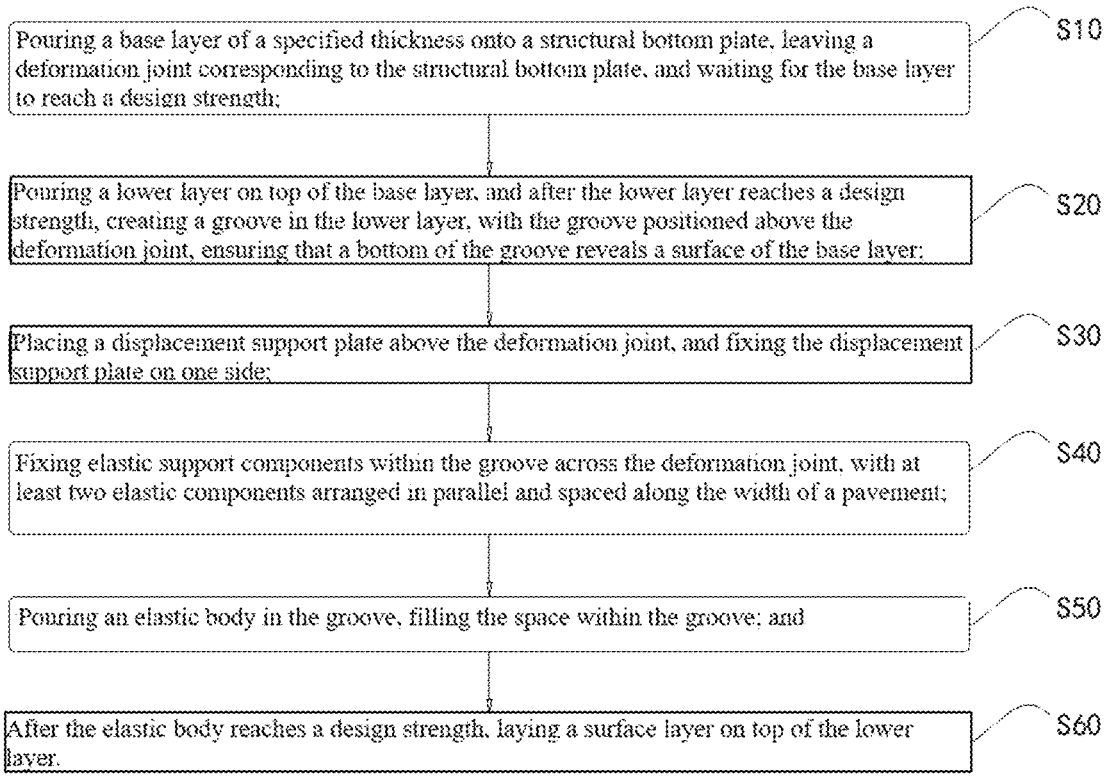
FIG. 5 is a flowchart of a construction method of a pavement structure according to an embodiment of the invention.

In the embodiments of the invention, a construction method of the aforementioned pavement structure is also provided, as shown in FIG. 5, which comprises the following steps. In some embodiments of the invention, the total thickness of the pavement structure is 350 mm.

S10, pouring a base layer 200 of a specified thickness onto a structural bottom plate 100, leaving a deformation joint 101 corresponding to the structural bottom plate 100, and waiting for the base layer 200 to reach a design strength. When pouring the base layer 200, the thickness is 250 mm, and the base layer 200 utilizes an ultra-tough cement-based composite material.

S20, pouring a lower layer 300 with a thickness of 60 mm on top of the base layer 200 by using warm-mixed asphalt concrete, and after the lower layer 300 reaches a design strength, creating a groove 301 with a width of 400 mm and a depth of 60 mm in the lower layer 300, with the groove 301 positioned above the deformation joint 101, ensuring that a bottom of the groove 301 reveals a surface of the base layer 200; and after the groove is created, cleaning the surface of the base layer 200 until dry and clean, and then filling the deformation joint 101 with a high-temperature-resistant caulking strip 201.

S30, placing a displacement support plate 10 sized 9000 mm×120 mm×5 mm above the deformation joint 101, and fixing the displacement support plate on one side using expansion screws, which must penetrate at least 70 mm deep; and after fixing one side of the displacement support plate 10, laying a rubber isolation layer sized 9000 mm×160 mm×2 mm on the displacement support plate 10.

S40, fixing elastic support components 20 within the groove 301 across the deformation joint 101, with at least two elastic components arranged in parallel and spaced along the width of a pavement; and then installing a spring telescopic rod, that is, a rigid telescopic member 22 in the embodiments of the invention. In some embodiments of the invention, angle steels are used for fixing the elastic support components, the angle steels are arranged on two sides of a bottom surface of the groove 301, 20 mm from two sides of the lower layer 300, and Q235 angle steels sized 35 mm×50 mm×7 mm are used.

S50, pouring an elastic body 30 in the groove 301, filling the space within the groove 301. Before pouring, a surface of the groove 301 is coated with an epoxy resin interfacial agent 32, the application amount being 1 kg/m$^2$, followed by a sealant 31, which is applied 5 mm thick at the bottom of the groove 301 and 2 mm thick on the sides. After coating, pouring of the elastic body 30 is started, and the specific composition and formulation of the elastic body 30 have been detailed above and will not be repeated here.

S60, after the elastic body 30 reaches a design strength, laying a surface layer 400 on top of the lower layer 300. The unified application of the surface layer 400 prevents contact between vehicles and the elastic body 30, extending the service life of the expansion device for deformation joints 101 and improving driving comfort.

Those skilled in the art should understand that the invention is not limited by the above-mentioned embodiments. What is described in the above-mentioned embodiments and the description is only to illustrate the principles of the invention. Without departing from the spirit and scope of the invention, the invention will have various changes and improvements, which all fall within the scope of the claimed invention. The protection scope of the invention is defined by the appended claims and their equivalents.

What is claimed is:

1. An expansion device for deformation joints which is installed in a groove above the deformation joint, comprising a displacement support plate which is positioned above the deformation joint and fixed on one of two sides of the deformation joint;

an elastic support component comprising fixed bases fixed on two sides of the displacement support plate and a rigid telescopic member connected to the two fixed bases, the rigid telescopic member being fixedly suspended above the deformation joint and having elasticity in a direction of a connecting line between the two fixed bases; and an elastic body which fills the groove above the deformation joint and submerges the elastic support component;

wherein two sides of the elastic body are connected to side walls of the groove above the deformation joint, and when the deformation joint expands or contracts, the elastic support component provides a deformation buffering force;

wherein the displacement support plate is a steel plate, a rubber isolation layer is laid on the displacement support plate, and the elastic body is able to slide relative to the displacement support plate along with the rubber isolation layer, that during stretching or compression, the elastic body can move over the steel plate along with the rubber isolation layer;

wherein the rigid telescopic member is arranged linearly and comprises an inner sliding rod, a sliding sleeve fitted over the inner sliding rod, and a first spring fitted between the inner sliding rod and the sliding sleeve;

wherein the rigid telescopic member further comprises a second spring fitted over the exterior of the sliding sleeve, during the pouring of the elastic body, the remaining part of the second spring is bonded and cured together with the elastic body.

2. The expansion device for deformation joints according to claim 1, wherein the two sides of the elastic body are coated with a sealant.

3. The expansion device for deformation joints according to claim 2, wherein an outer side of the sealant is coated with an epoxy resin interfacial agent.

4. The expansion device for deformation joints according to claim 1, wherein the rigid telescopic member is arranged in an arch shape and comprises an arch tube, the arch tube comprises an arch section and straight sections at two ends, and the rigid telescopic member further comprises inner rods fitted in the two straight sections and third springs fitted between the inner rods and the arch tube.

5. The expansion device for deformation joints according to claim 4, wherein the arch tube is further sleeved with a fourth spring.

6. The expansion device for deformation joints according to claim 1, wherein the elastic body is a high-elastic asphalt mixture.

7. The expansion device for deformation joints according to claim 6, wherein the high-elastic asphalt mixture is composed of polymer-modified asphalt and single-sized basalt aggregate, with a mass ratio of (30-40):100;

the polymer-modified asphalt comprises 100 parts of matrix asphalt, 15-25 parts of nano-sized rubber powder with a size of 80-250 nm, 10-15 parts of rubber particles with a size of 0.5-1 cm, 2-5 parts of activator, 1-2.5 parts of epoxy adhesive, 0.5-1.2 parts of polyvinyl alcohol fiber and 6-10 parts of composite synergist; and a particle size of the single-sized basalt aggregate is one of 5-10 mm, 10-15 mm and 15-20 mm.

8. A pavement structure, comprising a structural bottom plate, a base layer, a lower layer and a surface layer, wherein the base layer is laid on the structural bottom plate, and the base layer and the structural bottom plate are provided with a deformation joint separating the two in a vertical direction;

the lower layer is laid on the base layer, a groove is formed in the base layer above the deformation joint, and the expansion device for deformation joints according to claim 1 is fixed in the groove; and the surface layer is laid on the lower layer.

9. The pavement structure according to claim 8, wherein the deformation joint is also filled with a caulking strip, and the caulking strip is a foam strip.

10. A construction method of the pavement structure according to claim 9, comprising the following steps:

pouring a base layer of a specified thickness onto a structural bottom plate, leaving a deformation joint corresponding to the structural bottom plate, and waiting for the base layer to reach a design strength;

pouring a lower layer on top of the base layer, and after the lower layer reaches a design strength, creating a groove in the lower layer, with the groove positioned above the deformation joint, ensuring that a bottom of the groove reveals a surface of the base layer;

placing a displacement support plate above the deformation joint, and fixing the displacement support plate on one side;

fixing elastic support components within the groove across the deformation joint, with at least two elastic components arranged in parallel and spaced along the width of a pavement;

pouring an elastic body in the groove, filling the space within the groove; and after the elastic body reaches a design strength, laying a surface layer on top of the lower layer.

* * * * *